US006083895A

United States Patent [19]

Warwick

[11] Patent Number: 6,083,895

[45] Date of Patent: Jul. 4, 2000

[54] DETERGENT COMPOSITIONS IN TABLET FORM

[75] Inventor: Jane Margaret Warwick, Newcastle upon Tyne, United Kingdom

[73] Assignee: The Procter & Gamble Company, Cincinnati, Ohio

[21] Appl. No.: 08/913,262

[22] PCT Filed: Mar. 1, 1996

[86] PCT No.: PCT/US96/02769

§ 371 Date: Feb. 5, 1998

§ 102(e) Date: Feb. 5, 1998

[87] PCT Pub. No.: WO96/28530

PCT Pub. Date: Sep. 19, 1996

[30] Foreign Application Priority Data

Mar. 11, 1995 [GB] United Kingdom ..... 9504963

[51] Int. Cl.[7] ..... C11D 17/00; C11D 11/00

[52] U.S. Cl. ..... 510/224; 510/229; 510/231; 510/294; 510/298; 510/361; 510/446; 510/447; 510/477; 510/511; 510/512

[58] Field of Search ..... 510/224, 229, 510/231, 294, 298, 361, 446, 447, 477, 511, 512

[56] References Cited

U.S. PATENT DOCUMENTS

| | | | |
|---|---|---|---|
| 2,412,819 | 12/1946 | MacMahon | 510/224 |
| 3,370,015 | 2/1968 | van Kampen et al. | 510/446 |
| 3,520,317 | 7/1970 | Caldwell et al. | 253/199 |
| 4,219,435 | 8/1980 | Biard et al. | 510/439 |
| 4,219,436 | 8/1980 | Gromer et al. | 510/224 |
| 4,370,250 | 1/1983 | Joshi | 510/298 |
| 4,451,386 | 5/1984 | Joshi | 510/298 |
| 4,587,031 | 5/1986 | Kruse et al. | 510/224 |
| 4,690,770 | 9/1987 | Jeschke et al. | 510/224 |
| 4,729,845 | 3/1988 | Altenschoepfer et al. | 510/225 |
| 4,803,058 | 2/1989 | Highfill | 510/534 |
| 4,828,745 | 5/1989 | Jeschke et al. | 510/224 |
| 4,839,078 | 6/1989 | Kruse et al. | 510/224 |
| 4,897,212 | 1/1990 | Kruse et al. | 510/224 |
| 4,913,832 | 4/1990 | Kruse et al. | 510/224 |
| 5,759,976 | 6/1998 | Roach et al. | 510/218 |

FOREIGN PATENT DOCUMENTS

| | | | |
|---|---|---|---|
| 0 328 880 A1 | 8/1989 | European Pat. Off. | C11D 17/00 |
| 95/07976 | 3/1995 | WIPO | C11D 17/00 |

*Primary Examiner*—Lorna M. Douyon
*Attorney, Agent, or Firm*—Jacobus C. Rasser; Kim W. Zerby; Pankaj M. Khosla

[57] ABSTRACT

A tabletted detergent composition comprises from 45% to 80% by weight of a builder system which is not fully hydrated and from 5% to 30% total water content, wherein the total water content comprises water derived from the builder system, optional ingredients and from added water, wherein the ratio of the total water content to added water content is from 100:1 to 5:4. The tablet exhibits improved hardness and strength.

9 Claims, No Drawings

DETERGENT COMPOSITIONS IN TABLET FORM

FIELD OF THE INVENTION

The present invention relates to detergent compositions in tablet form having an improved hardness profile.

BACKGROUND OF THE INVENTION

The traditional form of detergent compositions for use in automatic dishwashing or laundry machines is granular or particulate. Such compositions are measured and dosed by the consumer and placed in the dispenser of the machine which is located in the door in the case of dishwashing machines or the dispensing tray of an automatic laundry washing machine.

In order to simplify the dosing of detergents for automatic washing machines however, many of the automatic washing detergent compositions are now provided in the form of non particulate solids such as bars or tablets or briquettes. This provides a number of advantages to both the consumer and manufacturer. Firstly, such tablets prevent spillage of the detergent composition. Secondly, the tablets eliminate the need for the consumer to estimate the dosage of detergent composition required and ensure that the correct dosage of detergent composition per wash is used by the consumer. Thirdly, the use of tablets minimises the contact by the consumer with the composition.

However, there are a number of problems associated with the use of tablets. In order to provide optimum performance benefits the tablets require a certain dissolution profile during the programme cycle of the machine.

In addition, it is also highly desirable that the tablets possess a certain degree of hardness or tablet strength. In particular the tablets should be sufficiently hard to meet safety requirements. Tabletted detergent compositions are typically highly alkaline and thus oral consumption must be avoided. However, tablets often appear attractive to children, who may attempt to consume them.

Furthermore, it is also desirable that the tablets should be hard enough so that they preferably do not deteriorate, lose their structure or decompose upon packing, transport or storage.

Background Art

Detergent tablets and methods of their preparation are known in the art. For example WO 94/23011 discloses stable, bifunctional phosphate-, metasilicate- and polymer free, low alkaline cleaning agent tablet for dishwashing machines. The composition may comprise from 1–60% anhydrous sodium carbonate, 0–60% sodium disilicate and 3–10% water.

WO 93/00419 discloses a process for producing phosphate and metasilicate free, low alkaline cleaning agent tablets for machine dishwashing. The tablets consist of solid alkali salts of at least one polymer of acrylic acid and builders including anhydrous sodium carbonate. The tablets may comprise anhydrous sodium disilicate. The carbonate undergoes mixing alone or together with other builders and the polymer and with from 5–40% water to result in the partial hydration of the carbonate. The remaining components are then added and compressed into tablet form.

WO 91/15568 discloses stable, phosphate free detergent tablets for use in dishwashing machines containing anhydrous meta silicate, nonionics, builders, bleach, 35–60% acrylic polymers, 25–50% anhydrous carbonate, 4–20% anhydrous sodium sulphate and 1–7% water. The tablets are prepared by compression such that they have a flexural strength of at least 120N.

EPO 481 792 discloses detergent compositions in tablet form comprising a persalt, bleach activator and 5–80% detergent builders, polymers (0.5–15%), alkali metal silicates (0.1%–10%), carbonate and sulphate (not disclosed as anhydrous). Water is not disclosed in the description but the exemplified tablet composition comprises 13.5–16.5% moisture in addition to carbonate, alkaline silicate and polymer. The tablets are prepared by compression of the premixed composition.

EPO 170 791 discloses a process for making a washing composition in tablet form. The process consists of granulating bleach activator, nonionic surfactants, quaternary ammonium compounds, fatty amine derivatives and aminopropanionic acid derivatives with tabletting aids and spraying the granulate with a liquid builder and drying to a water content of at most 6% and compressing into tablets.

All of the identified prior art documents disclose means of increasing tablet hardness using compression of the granular detergent composition following pretreatment of the granular composition ingredients. It is thus an aim of the present invention to provide a tabletted detergent composition having increased strength without substantially increasing the compression force.

It is a further aim of the present invention to provide a tablet having increased strength and hardness with minimal adaptation of the compression manufacturing process, particularly with respect to the tooling required for compression of the detergent composition into tablets.

It is a further aim of the present invention to provide a tabletted detergent composition having the desired dissolution profile.

SUMMARY OF THE INVENTION

The present invention is a carbonate free tabletted detergent composition comprising from 45% to 80% of a hydratable builder system, wherein said builder is not fully hydrated and from 5% to 30% total water content, wherein said total water content comprises water derived from said builder system, optional ingredients and from added water, wherein the ratio of said total water content to added water content is from 100:1 to 5:4.

All amounts, weights, ratios and percentages are as a % weight of the detergent composition unless otherwise stated.

DETAILED DESCRIPTION OF THE INVENTION

Thus, according to the present invention the detergent composition is in a tabletted form. As used herein the term tabletted refers to a non-particulate solid, which may be a bar, briquette, cake or tablet. The tabletted detergent composition of the present invention is a carbonate free composition comprising as essential ingredients a non fully hydrated builder system and water.

Builder System

The carbonate free tabletted detergent composition of the present invention comprises as an essential component from 45% to 80%, preferably from 65% to 75% of a detergency builder system. Said builder is not fully hydrated and is preferably less than 50% hydrated, more preferably less than 30% hydrated, most preferably less than 28% hydrated. As used herein the term fully hydrated builder refers to builders in which all the vacant co-ordination sites are occupied by water molecules. Suitable builders for use herein are described herein below. The builder may comprise essentially of only one builder component or a number of builder components. The degree of hydration of each of said components is independent of one another such that the overall hydration of the builder is the mean value of all of the builder components present in the detergent composition.

According to the present invention suitable builders for use in the present invention include inorganic or P-containing detergent builders including the alkali metal, ammonium and alkanolammonium salts of polyphosphates (exemplified by the tripolyphosphates, pyrophosphates, and glassy polymeric meta-phosphates), phosphonates, phytic acid, silicates, aluminosilicates and builder/fillers such as sulphates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminium. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Aluminosilicate builders are usefuil in the present invention. Aluminosilicate builders are of great importance in most currently marketed heavy duty granular detergent compositions. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilised in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance. Citrates may be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

The tabletted detergent composition of the present invention preferably comprises builders selected from sulphates, phosphates, silicates and mixtures thereof. More preferably the builders are selected in order of preference from silicate, sulphate, citrate, and mixtures thereof.

Water

According to the present invention the tabletted detergent compositions also comprise as an essential ingredient from 5% to 30%, preferably from 5% to 20%, most preferably from 10% to 15% of water. The water content of the tabletted detergent composition of the present invention may be determined by methods known and described in the art, such as distillation methods. Such methods determine the total water content i.e. mobile/free water and bound water present in the tablet.

Whilst not wishing to be bound by theory, it is believed that the ratio of free and bound water present in the tablet contributes to the hardness of the tablet. This ratio of free and bound water may be measured in terms of percentage equilibrium relative humidity or detection water. Preferably, the percentage equilibrium relative humidity is from 29% to 50%, preferably from 30% to 40%, more preferably from 30% to 38%, most preferably from 30% to 35% at 26° C. The water present in the tablet is mainly derived from the tablet ingredients themselves such as from the builder system. However, it has been found that in order to achieve the optimal ratio of free/mobile and bound water, water must be added by the formulator. Thus, it is an essential feature of the present invention that additional water is added to the detergent formulation, preferably prior to compression. Alternatively, the additional water is added to the detergent composition prior to tabletting by exposing the composition to a controlled humid environment. Preferably the tabletted detergent composition comprises from 0.3% to 4%, more preferably from 0.3% to 3%, most preferably from 0.3% to 1% of water by weight of the total detergent composition is added by the formulator and is not derived from the components of the tabletted composition. According to the present invention the ratio of total water content of the tabletted composition to added water is in the ratio of from 100:1 to 5:4, preferably 70:1 to 5:3, more preferably from 50:1 to 15:1.

Adjunct Ingredients

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Detersive Surfactants

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulphates ("AS"), the $C_{10}$–$C_{18}$ secondary (2,3) alkyl sulphates of the formula $CH_3(CH_2)_x(CHOSO_3^-M^+)CH_3$ and $CH_3(CH_2)_y(CHOSO_3^-M^+)\ CH_2CH_3$ where x and (y+1) are integers of at least about 7, preferably at least about 9, and M is a water-solubilizing cation, especially sodium, unsaturated sulphates such as oleoyl sulphate, the $C_{10-C18}$ alkyl alkoxy sulphates ("$AE_xS$"; especially EO 1–7 ethoxy sulphates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulphated polyglycosides, and $C_{12}$–$C_{18}$ alpha- fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. Mixtures of anionic and nonionic surfactants are especially useful. Other conventional useful surfactants are listed in standard texts.

Polymeric Dispersing Agents

Polymeric dispersing agents can advantageously be utilised at levels from about 0.1% to about 7%, by weight, in the compositions herein, especially in the presence of zeolite and/or layered silicate builders. Suitable polymeric dispersing agents include polyethylene glycols PEG, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

PEG can exhibit dispersing agent performance as well as act as a clay soil removal-antiredeposition agent. Typical molecular weight ranges for these purposes range from about 500 to about 100,000; preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Polymeric Carboxylates

According to the present invention another essential component of the tabletted detergent composition is a polymeric polycarboxylate. Said polymeric polycarboxylate is present at from 1% to 30%, preferably from 1% to 10%, more preferably from 1% to 5%.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, contaning no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylene diaminetriacetates, nitrilotriacetates, ethylenediamine tetraproprionates, triethylenetetraamine-hexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utlaised, these chelating agents will generally comprise from about 0.1% to about 10% by weight of the detergent compositions herein. More preferably, if utilised, the chelating agents will comprise from about 0.1% to about 3.0% by w eight of such compositions.

Enzymes

Enzymes can be included in the formulations herein for a wide variety of fabric laundering purposes, including removal of protein-based, carbohydrate-based, or triglyceride-based stains. The enzymes to be incorporated include proteases, amylases, lipases, cellulases, and. peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and tungal cellulases.

Enzyme s are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 10%, preferably 0.01% to 5% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Ser. No. 87303761.8, filed Apr. 28, 1987, and European Patent Application 130,756, Bott et al, published Jan. 9, 1985).

Amylases include, for example, Δ-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. 3,519, 570.

Enzyme Stabilizers

The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. 4,537,706.

Bleaching Compounds—Bleaching Agents and Bleach Activators

The detergent compositions herein may optionally contain bleaching agents or bleaching compositions containing a bleaching agent and one or more bleach activators. When present, bleaching agents will typically be at levels of from about 0.1% to about 30%, more typically from about 1% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

Mixtures of bleaching agents can also be used. Peroxygen bleaching agents, the perborates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamido-caproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

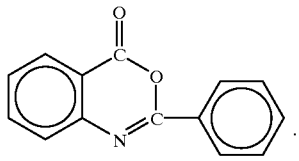

Still another class of preferred bleach activators includes the acyl lactam activators, especially acyl caprolactams and acyl valerolactams of the formulae:

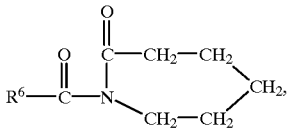

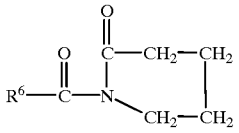

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilised herein. One type of non-oxygen bleaching agent of particular interest includes photoactivated bleaching agents such as the sulfonated zinc and/or aluminium phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u\text{-}O)_3$(1,4,7-trimethyl-1,4,7-triazacyclo-nonane)$_2(PF_6)_2$, $Mn^{III}_2(u\text{-}O)_1(u\text{-}OAc)_2$(1,4,7-trimethyl-1,4,7-triazacyclononane)$_2\text{-}(ClO_4)_2$, $Mn^{IV}_4(u\text{-}O)_6$(1,4,7-triazacyclononane)$_4(ClO_4)_4$, $Mn^{III}Mn^{IV}_4(u\text{-}O)_1(u\text{-}OAc)_2\text{-}$(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; 5,227,084;

Corrosion Inhibitor Compound

The compositions may contain corrosion inhibitors preferably selected from organic silver coating agents, particularly paraffin, nitrogen-containing corrosion inhibitor compounds, bismuth compounds and Mn(II) compounds, particularly Mn(II) salts of organic ligands.

Organic silver coating agents are described in PCT Publication No. WO94/16047 (attorney's docket no. CM497M) and copending UK Application No. UK 9413729.6 (attorney's docket no. CM750F). Nitrogen-containing corrosion inhibitor compounds are disclosed in copending European Application no. EP 93202095.1 (attorney's docket no. CM571F). Mn(II) compounds for use in corrosion inhibition are described in copending UK Application No. 9418567.5 (attorney's docket no. CM719FM).

Organic Silver Coating Agents

Organic silver coating agent may be incorporated at a level of from 0.05% to 10%, preferably from 0.1% to 5% by weight of the total composition.

The functional role of the silver coating agent is to form 'in use' a protective coating layer on any silverware components of the washload to which the compositions of the invention are being applied. The silver coating agent should hence have a high affinity for attachment to solid silver surfaces, particularly when present in as a component of an aqueous washing and bleaching solution with which the solid silver surfaces are being treated.

Suitable organic silver coating agents herein include fatty esters of mono- or polyhydric alcohols having from 1 to about 40 carbon atoms in the hydrocarbon chain.

The fatty acid portion of the fatty ester can be obtained from mono- or poly-carboxylic acids having from 1 to about 40 carbon atoms in the hydrocarbon chain. Suitable examples of monocarboxylic fatty acids include behenic acid, stearic acid, oleic acid, palmitic acid, myristic acid, lauric acid, acetic acid, propionic acid, butyric acid, isobutyric acid, valeric acid, lactic acid, glycolic acid and β,β'-dihydroxyisobutyric acid. Examples of suitable polycarboxylic acids include: n-butyl-malonic acid, isocitric acid, citric acid, maleic acid, malic acid and succinic acid.

The fatty alcohol radical in the fatty ester can be represented by mono- or polyhydric alcohols having from 1 to 40 carbon atoms in the hydrocarbon chain. Examples of suitable fatty alcohols include; behenyl, arachidyl, cocoyl, oleoyl and lauryl alcohol, ethylene glycol, glycerol, ethanol, isopropanol, vinyl alcohol, diglycerol, xylitol, sucrose, erythritol, pentaerythritol, sorbitol or sorbitan.

Preferably, the fatty acid and/or fatty alcohol group of the fatty ester adjunct material have from 1 to 24 carbon atoms in the alkyl chain.

Preferred fatty esters herein are ethylene glycol, glycerol and sorbitan esters wherein the fatty acid portion of the ester normally comprises a species selected from behenic acid, stearic acid, oleic acid, palmitic acid or myristic acid.

The glycerol esters are also highly preferred. These are the mono-, di- or trimesters of glycerol and the fatty acids as defined above.

Specific examples of fatty alcohol esters for use herein include: stearyl acetate, palmityl di-lactate, cocoyl isobutyrate, oleyl maleate, oleoyl dimaleate, and tallowyl proprionate. Fatty acid esters useful herein include: xylitol monopalmitate, pentaerythritol monostearate, sucrose monostearate, glycerol monostearate, ethylene glycol monostearate, sorbitan esters. Suitable sorbitan esters include sorbitan monostearate, sorbitan palmitate, sorbitan monolaurate, sorbitan monomyristate, sorbitan monobehenate, sorbitan mono-oleate, sorbitan dilaurate, sorbitan distearate, sorbitan dibehenate, sorbitan dioleate, and also mixed tallowalkyl sorbitan mono- and di-esters.

Glycerol monostearate, glycerol mono-oleate, glycerol monopalmitate, glycerol monobehenate, and glycerol distearate are preferred glycerol esters herein.

Suitable organic silver coating agents include triglycerides, mono or diglycerides, and wholly or partially hydrogenated derivatives thereof, and any mixtures thereof. Suitable sources of fatty acid esters include vegetable and fish oils and animal fats. Suitable vegetable oils include soy bean oil, cotton seed oil, castor oil, olive oil, peanut oil, safflower oil, sunflower oil, rapeseed oil, grapeseed oil, palm oil and corn oil.

Waxes, including microcrystalline waxes are suitable organic silver coating agents herein. Preferred waxes have a melting point in the range from about 35° C. to about 110° C. and comprise generally from 12 to 70 carbon atoms. Preferred are petroleum waxes of the paraffin and microcrystalline type which are composed of long-chain saturated hydrocarbon compounds.

Alginates and gelatin are suitable organic silver coating agents herein.

Dialkyl amine oxides such as $C_{12}$–$C_{20}$ methylamine oxide, and dialkyl quaternary ammonium compounds and salts, such as the $C_{12}$–$C_{20}$ methylammonium halides are also suitable.

Other suitable organic silver coating agents include certain polymeric materials. Polyvinylpyrrolidones with an average molecular weight of from 12,000 to 700,000, polyethylene glycols (PEG) with an average molecular weight of from 600 to 10,000, polyamine N-oxide polymers, copolymers of N-vinylpyrrolidone and N-vinylimidazole, and cellulose derivatives such as methylcellulose, carboxymethylcellulose and hydroxyethylcellulose are examples of such polymeric materials.

Certain perfume materials, particularly those demonstrating a high substantivity for metallic surfaces, are also useful as the organic silver coating agents herein.

Other Ingredients

A wide variety of other ingredients useful in detergent compositions can be included in the compositions herein, including other active ingredients, carriers, hydrotropes, processing aids, dyes or pigments, etc. If desired, soluble magnesium salts such as $MgCl_2$, $MgSO_4$, and the like, can be added at levels of, typically, 0.1%–2%, to provide enhanced grease removal performance. Ingredients may also be incorporated to assist in the tabletting process such as lubricating agents, sodium acetate and nonionic surfactants.

Tablet Preparation

Another aspect of the present invention relates to the preparation of the tabletted detergent composition. The tablet may be manufactured using any suitable compacting process, such as tabletting, briquetting or extrusion, preferably tabletting. Preferably the tablets are manufactured using a standard rotary tabletting press (such as Courtoy RS) using compression forces of from 5 to 13KN/cm$^2$, more preferably from 5 to 11KN/cm$^2$.

According to the present invention the tablets are prepared by dry mixing the not fully hydrated builder/filler system, optional ingredients selected from polymeric polycarboxylates, chelants, bleach and bleach activator and then adding water and optionally other ingredients which may be sprayed on such as nonionic surfactants, chelants and silvercare additives. Prior to compaction any additional sensitive ingredients such as enzymes, dyes and perfumes are dry mixed.

The composition is then tabletted by conventional means, on a 12 head rotary press under a compression force of 5–13KN/cm$^2$ so that the tablet has a minimum hardness of 176N to 245N, preferably from 195N to 275N, measured by a C100 hardness test as supplied by I. Holland Instruments. These processes may be used to prepare homogenous or layered tablets of any size or shape. Preferably the tablets are symmetrical to ensure the uniform dissolution of the tablet in the wash liquor.

According to the present invention said tabletted detergent composition may find utility in all types of automatic dish- and laundry washing machines including industrial and domestic.

Abbreviations used in Examples

In the detergent compositions, the abbreviated component identifications have the following meanings:

| | |
|---|---|
| 35EY | A mixture of $C_{13-15}$ predominantly linear primary alcohol condensed with an average of 2 and 6 moles of ethylene oxide |
| Silicate | Sodium Silicate ($SiO_2$:$Na_2O$ ratio = 2.0) |
| Sulphate | Anhydrous sodium sulphate |
| AA | Homopolymer of acrylic acid, average molecular weight about 8,000. |
| Citrate | Tri-sodium citrate dihydrate |
| DETPMP | Diethylene triamine penta (Methylene phosphonic acid), marketed by Monsanto under the Tradename Dequest 2060 |
| TAED | Tetraacetyl ethylene diamine |
| Perborate | Anhydrous sodium perborate monohydrate bleach |
| Paraffin | Paraffin oil sold under the tradename Winog 70 by Wintershall |

EXAMPLE

The following tabletted detergent compositions suitable for use in an automatic dishwashing machine were prepared as described. The tablet were prepared by dry mixing all of the components except HEDP, Benzotrioazole, paraffin, enzymes and the added water. The HEDP, benzotriazole, paraffin, nonionic surfactant and water are then sprayed on and the composition mixed. The enzymes and additional sensitive ingredients are then added prior to compression to produce a 25 g tablet.

| Tablet | Ref | I | II | III |
|---|---|---|---|---|
| Citrate | 25 | 25 | 33 | 26.4 |
| AA | 3.2 | 3.2 | 4 | 3.2 |
| Silicate | 26.4 | 26.4 | 33 | 26.4 |
| HEDP | 0.66 | 0.66 | 0.83 | 0.66 |
| PB1 | 1.56 | 1.56 | 1.95 | 1.56 |
| PB4 | 6.92 | 6.92 | 8.65 | 6.91 |
| TAED | 4.36 | 4.36 | 5.45 | 4.36 |
| Enzymes | 3 | 3 | 3.8 | 3 |
| Silvercare additive | 0.64 | 0.64 | 0.8 | 0.6 |
| 35EY | 1.2 | 1.2 | 1.5 | 1.2 |
| Sulphate | 23 | 22 | — | 1.95 |
| Added Water | 0 | 0.5 | 0.7 | 1.0 |
| Misc. | | | Balance to 100% | |
| Total water content | 11.8 | 12.3 | 12.5 | 12.8 |
| Equilibrium relative humidity at 26° C. | 28.6 | 28.8 | 31.4 | 30.9 |
| av. Hardness | 144N | 239N | 221N | 220N |

What is claimed is:

1. A carbonate free tabletted detergent composition, comprising:

from 45% to 80% by weight of a hydratable builder system, said builder system not being fully hydrated;

from 12.3% to 15% by weight total water content, said total water content comprising water derived from said builder system and from added water, wherein the weight ratio of said total water content to added water is in a range of from 50:1 to 12.8:1; and detergent adjuncts selected from the group consisting of surfactants, bleaches, chelants, enzymes, and mixtures thereof.

2. A tabletted detergent composition according to claim 1, wherein the weight ratio of said water content to added water is in a range of from 24.6:1 to 12.8:1.

3. A tabletted detergent composition according to claim 1, wherein said tabletted detergent composition has a percentage equilibrium relative humidity in a range of from 29% to 50% at a temperature of 26° C.

4. A tabletted detergent composition according to claim 1, wherein said builder system is less than 50% hydrated.

5. A tabletted detergent composition according to claim 1, wherein said builder system comprises builders selected from the group consisting of a sulphate, phosphate, citrate, silicate, or a mixture thereof.

6. A tabletted detergent composition according to claim 5, wherein said builder is a sulphate, citrate, silicate, or mixture thereof.

7. A tabletted detergent composition according to claim 1, comprising from 65% to 75% by weight of said builder.

8. A tabletted detergent composition according to claim 1, further comprising from 1% to 30% by weight of a polymeric polycarboxylate.

9. A process for producing tabletted detergent compositions according to claim 1, comprising the steps of:

mixing said builder system;

adding from 0.3% to 4% by weight water; and tabletting the composition by compression.

* * * * *